US007344483B2

(12) United States Patent
Tacconi

(10) Patent No.: US 7,344,483 B2
(45) Date of Patent: Mar. 18, 2008

(54) DYNAMIC FOOTSTOOL DEVICE

(75) Inventor: Enrico Tacconi, Via Canalburo 133, Sarzana (IT) I-19038

(73) Assignee: Enrico Tacconi, Sarzana (IT)

( * ) Notice: Subject to any disclaimer, the term of this patent is extended or adjusted under 35 U.S.C. 154(b) by 0 days.

(21) Appl. No.: 10/541,712

(22) PCT Filed: Jan. 9, 2003

(86) PCT No.: PCT/EP04/00060

§ 371 (c)(1),
(2), (4) Date: Jan. 9, 2006

(87) PCT Pub. No.: WO2004/062434

PCT Pub. Date: Jul. 29, 2004

(65) Prior Publication Data

US 2006/0100077 A1 May 11, 2006

(30) Foreign Application Priority Data

Jan. 9, 2003 (IT) ..... FI2003A0006

(51) Int. Cl.
*A63B 23/08* (2006.01)

(52) U.S. Cl. ..... 482/79; 482/147

(58) Field of Classification Search ..... 482/79, 482/80, 146–148, 110; 446/166, 168
See application file for complete search history.

(56) References Cited

U.S. PATENT DOCUMENTS 478,166 A * 7/1892 Madsen ..... 482/146
1,509,793 A * 9/1924 Thompson ..... 482/79
1,565,484 A * 12/1925 McWhirter ..... 482/146
1,769,199 A 7/1930 Baxter
2,206,902 A * 7/1940 Kost ..... 601/27
4,186,920 A 2/1980 Fiore et al. ..... 272/96
4,739,986 A * 4/1988 Kucharik et al. ..... 482/79
5,368,536 A * 11/1994 Stodgell ..... 482/79
5,851,166 A 12/1998 Bernardson ..... 482/79
6,019,712 A * 2/2000 Duncan ..... 482/110
6,042,521 A 3/2000 De Giorgis ..... 482/79
6,306,068 B1 10/2001 Heatwole ..... 482/146
6,821,235 B1 * 11/2004 Johnson et al. ..... 482/79

FOREIGN PATENT DOCUMENTS

| | | | |
|---|---|---|---|
| FR | 2510895 | | 2/1983 |
| FR | 2674140 | | 9/1992 |
| FR | 2510895 | * | 2/1993 |
| GB | 2375492 | | 11/2002 |
| JP | 2001012073 | | 1/2001 |
| WO | WO86/04250 | | 7/1986 |

* cited by examiner

*Primary Examiner*—Lori Amerson
*Assistant Examiner*—Tam Nguyen
(74) *Attorney, Agent, or Firm*—Ohlandt, Greeley, Ruggiero & Perle, L.L.P.

(57) ABSTRACT

A footstool is described which allows to exercise feet, legs and ankles even while being in a seated position.

8 Claims, 2 Drawing Sheets

DYNAMIC FOOTSTOOL DEVICE

CROSS REFERENCE RELATED APPLICATION

This is a 371 of PCT/EP04/00060 filed Jan. 8, 2004.

TECHNICAL FIELD

The following invention relates to the field of physical wellness products, in particular for the exercising of the lower extremities and joints (feet, legs, ankles and knees).

BACKGROUND ART

It is known that remaining seated for long period of time, as required, for example, by office work, often causes problems to the lower extremities that present with a tingling sensation and in subjects that are prone, with aches and pains in the leg and calf, ankle swelling and other similar disorders.

In order to prevent such bothersome inconveniences, or to combat their effects, the only solution is to interrupt the seated activity and exercise a little In order to recover the normal activity of the interested limbs.

The advantage that can be obtained from a simple device that makes it possible to perform these activities from a seated position thus avoiding the abovementioned inconveniences without interrupting activity is, however, evident.

SUMMARY OF THE INVENTION

This invention relates to a device, hereinafter referred to as "dynamic footstool" that makes it possible to keep the lower extremities and joints in movement, by means of mobile footrests fitted around a support.

DETAILED DESCRIPTION OF THE INVENTION

Figure 1:
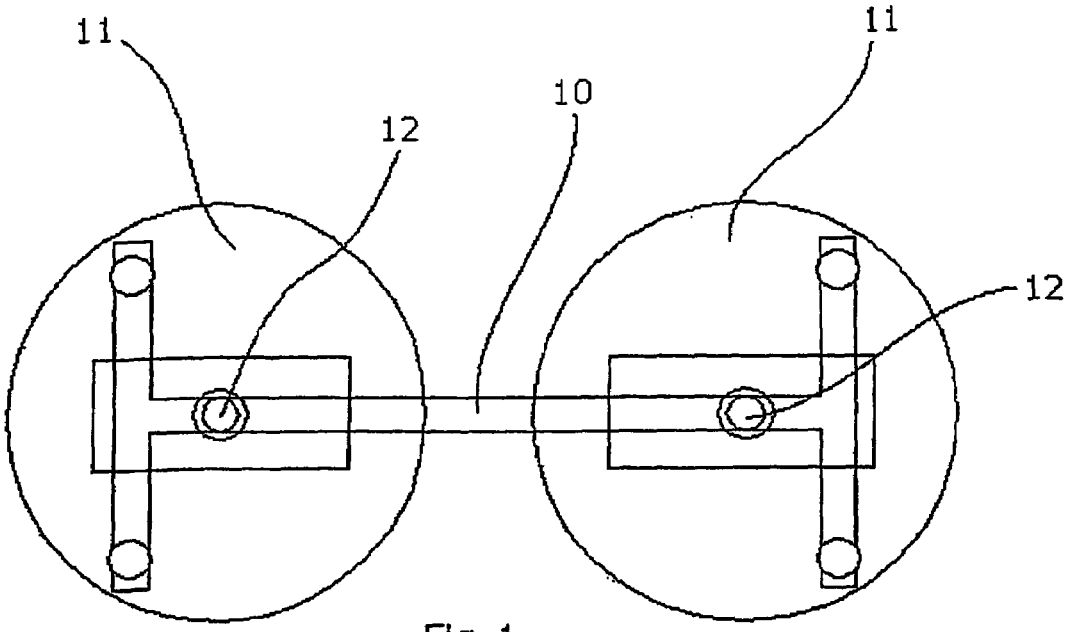
FIG. 1 illustrates a plan view of a device according to the invention.
Figure 2:
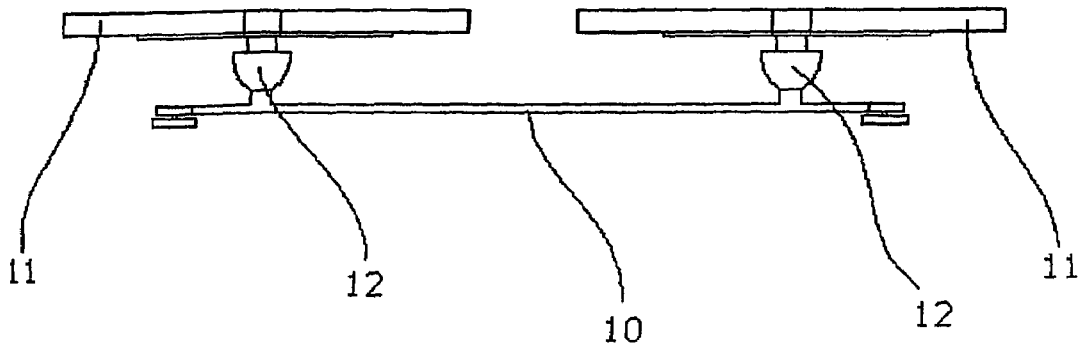
FIG. 2 illustrates a prospective view of a device according to the invention.

As can be seen in FIG. 1, the dynamic footstool according to the invention consists of a base 10 where two footrests 11 are integrally joined thereto by means of joints 12.

The base 10 is a structure having any shape that allows it to rest firmly on the ground, such as an "H" shape.

If preferred, said base may be fitted with adjustable feet on the surface in contact with the ground that make it possible to raise or lower the base as necessary or alternatively with non-slip rubber pads.

The joints 12 are such as to ensure free rotation of the footrests 11 on a plane parallel to the plane containing the base 10 and, simultaneously, their inclination In relation to said plane, in all spatial directions. Said joints should preferably be ball-and-socket joints, but they may be replaced by other equivalent mechanical solutions (springs, articulated joints etc.). Said joints must however have a suitable size to ensure that the footrests 11 may tilt in the various directions without touching the base 10 or the ground and preferably they will be attached to the barycentre of the footrests 11.

The footrests 11 must be such as to allow for a comfortable resting of feet with shoes and can have a range of shapes in order to allow, for example, comfortable resting of high-heeled shoes (such as those in the case of women's footwear); moreover, on their upper surface a layer of a non-slip material may be provided. According to a particular embodiment of this invention, said footrests are circular in shape.

According to a further particular embodiment of the invention, the footrests 11 consist of a solid body suitable for resting feet, which is hollow inside and in the cavity thereof a mobile mass that accentuates arid accompanies the movement of the footrests themselves is provided.

Figure 3:
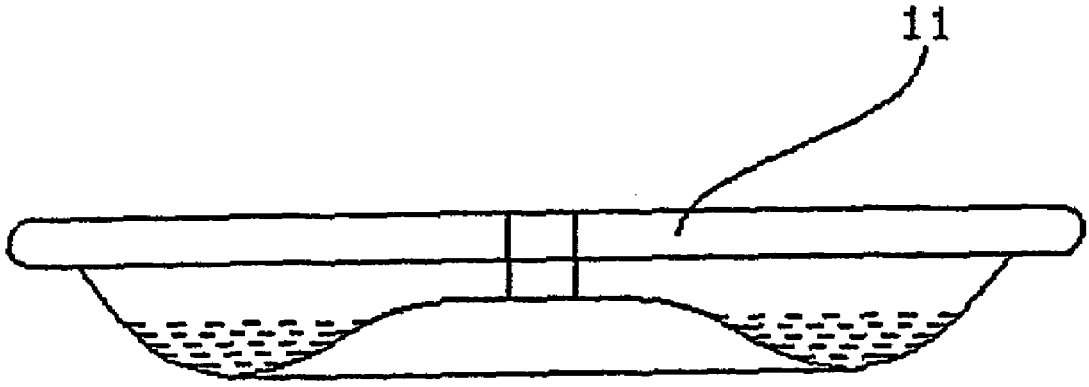
FIG. 3 shows a particular embodiment of the present invention.

If preferred, in this case the footrest 11 may have a bowl-shape, as shown in FIG. 3.

Said mobile mass may be, for example a liquid (such as water, viscous liquid, oil, etc.) or it may consist of a collection of small particles (small metal or marble spheres, etc., sand, plaster, etc.) or an admixture of both the abovementioned solutions.

Very viscous oils are particularly preferred for composing the abovementioned mobile mass.

If preferred, the device according to the invention can present a single footrest 11, hinged to the base 10 by a joint 12 analogously to what described above, having such dimensions as to consent the resting of one or both feet.

The device according to the invention can be manufactured using any material suitable to the purpose, the materials which allow to limit the weight of the devices without compromising its solidity (such as plastic, aluminium, etc.) will be obviously preferred.

The use of the device according to the invention is intuitive.

The user rests his/her feet on the rests 11 whilst continuing the activity performed in a seated position.

Even without paying voluntary attention, due to the simple composed effect of the intrinsic instability of the rests on the joints and small movements, which are also performed whilst seated, the feet will be caused to move in the various directions allowed by the joints 12 and therefore the joints and the legs will be always gently moved, thus not only preventing the aforementioned bothersome disorders, but also stimulating circulation in the lower limbs and therefore substantially contributing to their tone and, consequentially, to the user's overall well-being.

The invention claimed is:

1. A footstool device adapted to rest upon a support surface, the device comprising at least one footrest, one base to which said at least one footrest is firmly attached by means of a joint capable of allowing said at least one footrest to rotate freely on a horizontal plane parallel to a plane containing the base and to assume inclinations, in relation to said plane containing the base, in all spatial directions, wherein said at least one footrest comprises a solid bowl shaped body comprising a substantially planar top surface, a multi-curved bottom surface and an internal cavity containing a mobile mass that is movable throughout the entire cavity, having said joint located in a position which is coincident with or higher than the barycenter of said foot rests.

2. A footstool according to claim 1 wherein said joint is a ball and socket joint.

3. A footstool according to claim 1 wherein said joints is sized in such a way so as to allow the footrest to tilt in all spatial directions without the footrest touching the base or the support surface.

4. A footstool according to claim 3 wherein said at least one footrest has a circular shape.

5. A Footstool according to claim 1 wherein said mobile mass is a liquid.

6. A Footstool according to claim 1 wherein the upper surface of said at least one footrest comprises a layer of non-slip material.

7. A Footstool according to claim 1 wherein said base comprises either adjustable feet that allow the base to be raised or lowered as required, or non-slip rubber pads.

8. The footstool device according to claim 1, wherein said joint has a suitable size so that said footrest moves in all spatial directions without touching the base or the ground.

* * * * *